United States Patent [19]

Anderson

[11] Patent Number: 4,478,202

[45] Date of Patent: Oct. 23, 1984

[54] FORCE MULTIPLYING ARCHERY BOW

[76] Inventor: Jeffrey J. Anderson, P.O. Box 11, Pottersville, N.J. 07979

[21] Appl. No.: 277,287

[22] Filed: Jun. 25, 1981

[51] Int. Cl.[3] ..... F41B 5/00

[52] U.S. Cl. ..... 124/23 R; 124/32

[58] Field of Search ..... 124/23 R, 24 R, 88, 124/1, 16, 25, 35 A, 90, 86, 32

[56] References Cited

U.S. PATENT DOCUMENTS

| | | | |
|---|---|---|---|
| 3,841,295 | 10/1974 | Hunter | 124/88 X |
| 4,078,537 | 3/1978 | Carella | 124/24 R |
| 4,203,412 | 5/1980 | Rickard | 124/23 R |
| 4,207,858 | 6/1980 | Blackstone | 124/23 R |
| 4,244,345 | 1/1981 | Simd et al. | 124/16 X |

*Primary Examiner*—Richard J. Apley
*Assistant Examiner*—William R. Browne
*Attorney, Agent, or Firm*—Fisher, Christen & Sabol

[57] ABSTRACT

An archery bow is provided with a system whereby of which the force applied to bending the bow is multiplied when the drawstring is pulled back by the user. This is accomplished by attaching a second string between the bow limbs and using a mechanical gearing or other force-multiplying system actuated by a lever which is pulled with the main drawstring. At full draw both strings are simultaneously released. Electrical, hydraulic or pneumatic force multiplying devices can also be used to draw the second string.

3 Claims, 11 Drawing Figures

FIG. 1
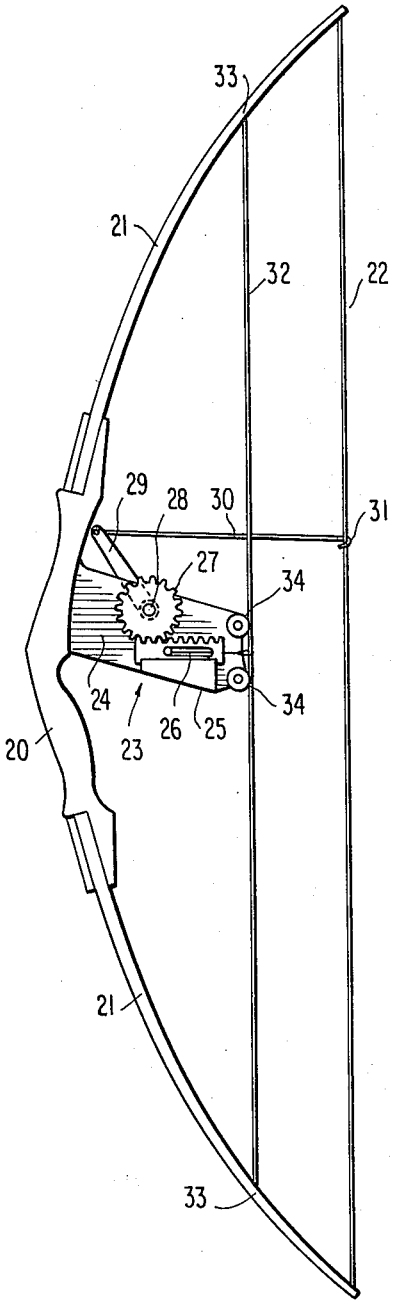
FIG. 2
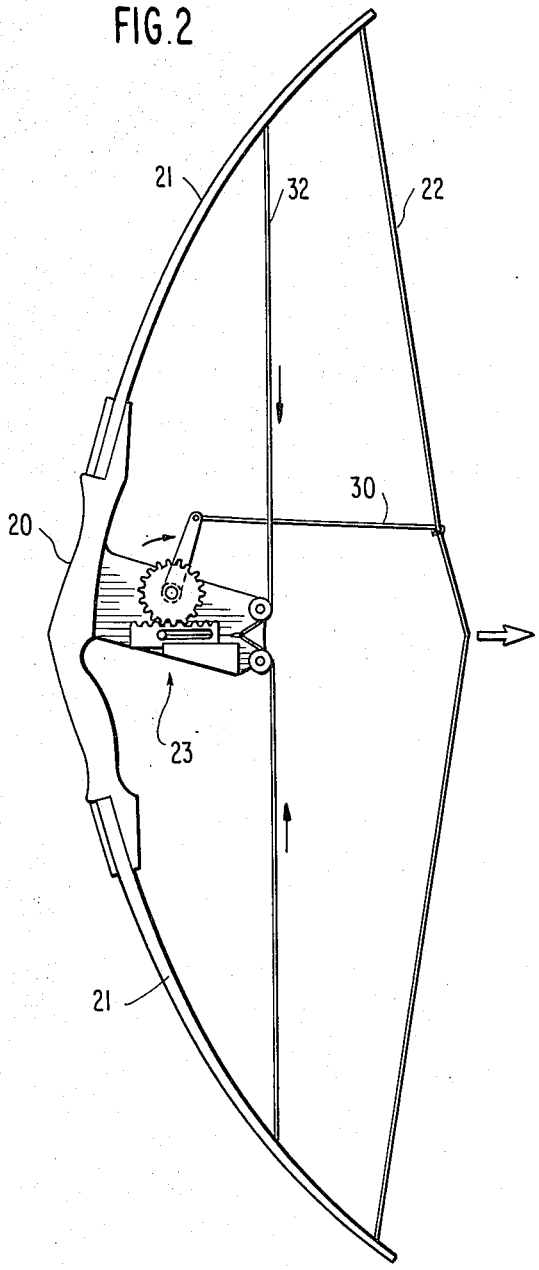
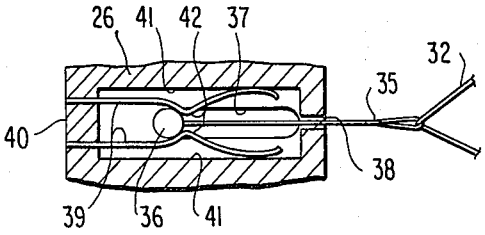
FIG. 3
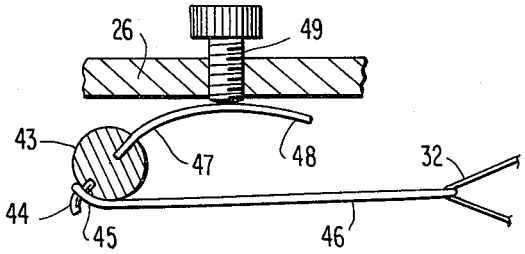
FIG. 4

FIG. 5
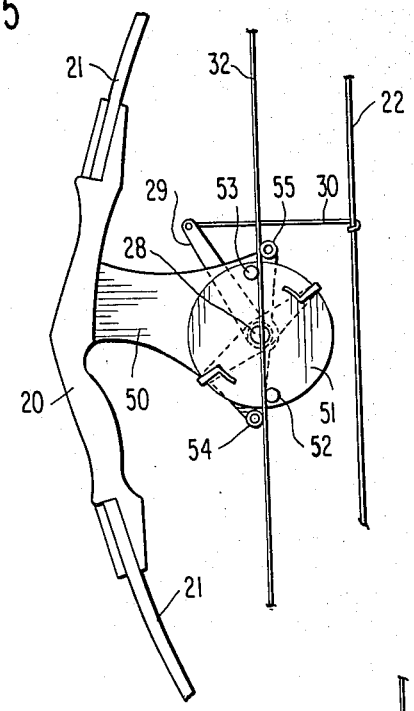
FIG. 6
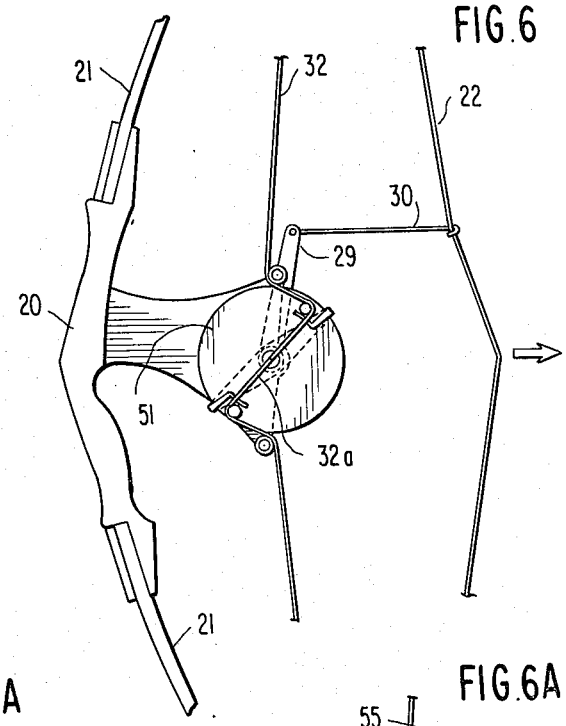
FIG. 5A
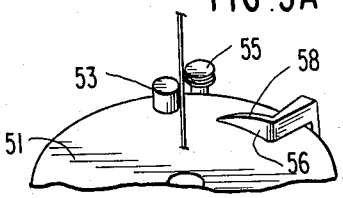
FIG. 6A
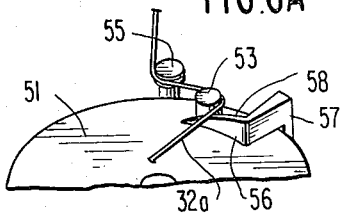
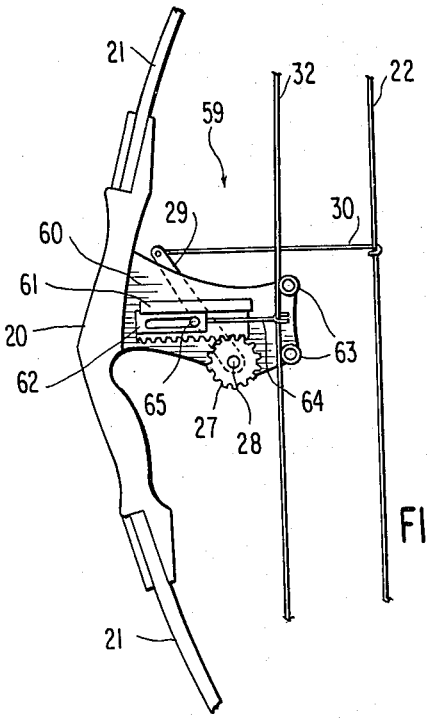
FIG. 7
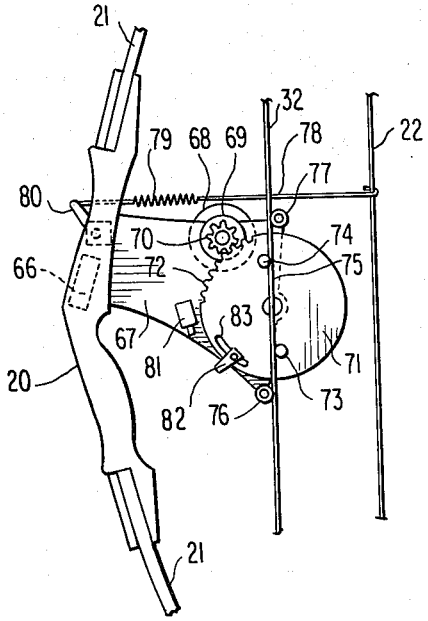
FIG. 8
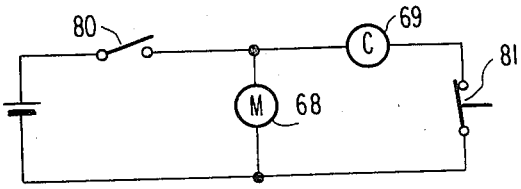
FIG. 9

FORCE MULTIPLYING ARCHERY BOW

BACKGROUND OF THE INVENTION

This invention relates to an archery bow of the type wherein a force-multiplying means is provided to increase the force applied to the limbs of a bow to bend them inwardly when the drawstring is pulled back in launching an arrow.

In U.S. Pat. No. 1,885,962 a bow is disclosed in which an elastic string is connected between one of the limbs and a medial point on another string which is connected between the center of the drawstring and the center of the bow. While the purpose of this system is to limit the drawstring pull, a certain amount of additional force is exerted on the one limb when the drawstring is pulled.

Another form of force multiplication is obtained by the use of eccentrically mounted cam wheels, or rollers, placed on the bow limbs with a single drawstring running back and forth several times between the rollers to terminate at fixed end positions on the bow. Bows of this type are disclosed in U.S. Pat. Nos. 3,486,495; 3,958,551; 3,854,467 and 3,967,609.

Another type of force-multiplying bow involves the use of eccentrically mounted rollers, or levers mounted on fixed limbs with the drawstring passing over these rollers, or levers, to a pair of auxiliary limbs which are flexed in response to pulling the drawstring. Bows of this type are disclosed in U.S. Pat. Nos. 3,851,638; 3,812,835 and 4,076,005.

BRIEF SUMMARY OF THIS INVENTION

In one form of the invention a second string extends between the limbs of the bow parallel with the main drawstring. A lever-operated gearing or othe force-multiplier is mounted on the bow and detachably connected to the second drawstring. A connection is made between the lever and the main drawstring so that when the latter is pulled, the lever is moved to exert force on the second drawstring as well. At the appropriate point, a tripping mechanism disconnects the second drawstring from the force-multiplier, and the main drawstring is also released by the archer.

Another mechanical arrangement involves the use of a rotary wheel having a pair of peripherally located pins to intersect the second drawstring to shorten it when the wheel is turned.

Electrical, hydraulic or pneumatic motor means mounted on the bow can also be utilized to actuate the second drawstring in response to a pull exerted on the main drawstring.

BRIEF DESCRIPTION OF THE DRAWINGS

In the drawings

FIG. 1 is a view in elevation of a preferred form of an archery bow constructed in accordance with this invention;

FIG. 2 is a similar view but with the drawstring partially pulled towards its release position;

FIG. 3 is an enlarged fragmentary cross-section of a tensioning string release mechanism;

FIG. 4 is a fragmentary cross-section of a modified form of the release mechanism;

FIG. 5 is partial new in elevation of a modified form of the force multiplying means;

FIG. 5A is an enlarged perspective view of the tripping mechanism of FIG. 5;

FIG. 6 is a view similar to FIG. 5 but with the drawing string partially pulled;

FIG. 6A is a perspective view similar to FIG. 5A showing the operation of the tripping mechanism;

FIG. 7 is a partial view in elevation of another modified form of force multiplying means;

FIG. 8 is a partial view in elevation of still another modified form of the force multiplying mechanism activated by an electric motor; and FIG. 9 is a circuit diagram for the force multiplying mechanism of FIG. 8.

DESCRIPTION OF A PREFERRED EMBODIMENT OF THE INVENTION

Referring now to the drawings, there is shown a bow having a central handle 20, to which are attached a pair of oppositely extending resilient limbs 21, to the extremities of which there are attached the two ends of a drawstring 22.

Also attached to the handle 20 is a force multiplying means, indicated generally by numeral 23 which assists the archer in bending the limbs 21 when the drawstring 22 is pulled. This mechanism includes a rearwardly extending mounting plate, or bracket, 24 which supports a guide 25 for a forwardly and backwardly slidable toothed rack 26 which is engaged by a gear 27 rotatably mounted on plate 24 by means of a shaft 28 which also carries an arm 29 for rotating the gear. The outer end of the arm is connected to one end of a cord, or rod, 30 which extends directly backwardly and has its other end 31 connected to the drawstring 22 at a point near its center.

The force multiplying means also includes a tensioning string 32 which has its ends connected to the limbs 21 at the points indicated by numeral 33 to position the tensioning string 32 forwardly of, and generally parallel to, the drawstring 22. In the normal condition of the bow, without an arrow in place as shown in FIG. 1, with the drawstring 22 under minimum tension, the string 32 will be in a taunt condition with its central portion in contact with a pair of grooved rollers 34 mounted on bracket 24 and spaced from each other. The tensioning string 32 is connected to one end of a cord, or wire, 35 extending forwardly between the two rollers 34 and having its other end connected to an element 36, shown in FIG. 3. The rack 26 is provided with an elongated hollow interior and element 36 may comprise a cylindrical bar, the ends of which are slidably received in slots 37 provided in the sides of the rack, one end of the rack being provided with a passage 38 to permit the entrance into the hollow chamber of the cord 35. Also contained in the chamber are a pair of leaf spring members 39 disposed on opposite sides of element 36. These springs 39 are fixed at one of the ends to the end wall 40 of the rack, while their ends are convergently bowed for sliding engagement with the opposite interior wall 41 of the chamber. At a medial point along their lengths each of the springs 39 is formed with an inwardly directed step, as indicated at 42, the distance between them being normally somewhat less than the diameter of element 36.

In operation, when the bow is in "unstressed" condition as shown in FIG. 1, the element 36 is placed in the space between the springs 39 on the side of the constrictions 42 away from the tensioning string 32, as seen in FIG. 3. When the archer has the arrow in place and begins to pull the drawstring 22 in the direction of the outlined arrow, as in FIG. 2, the string 30 begins to rotate the gear 27 in a clockwise direction by means of arm 29, causing the rack 26 to move to the left. This movement causes the element 36 to pull on the cord 35 and to draw the portion of the tensioning string 32 lying between pulleys 34 with it. This has the effect of shortening the overall length of string 32 creating inward tension on the bow limbs 21. Thus the force exerted by the archer, in drawing on string 22 is multiplied whereby the limbs may be designed to exert a force several times greater than if no force multiplier were in place. Of course, as the rack 26 continues to move to the left and the inward deformation of the limbs 21, the tension in sting 32 and cord 35 increases up to a point at which the force of element 36 bearing against the constrictions 42 forces the bowed portion of springs 39 to allow the constrictions 42 to spread apart a sufficient amount to release element 36. At this point it will move to the right hand end of the chamber, releasing tension in the connecting cord 35 and tensioning string 32; it is at this point that the archer releases drawstring 22 and the arrow is propelled forwardly under the full force of the suddenly released limbs 21.

In FIG. 4 there is shown a modified form of release mechanism for the tensioning string 32. In this case the rack 26 may be provided within the hollow chamber with an element 43, such as a roller, mounted 44 for rotation about a fixed axis perpendicular to the plane of the drawings. A radially projecting hook 44 is located at one point on the periphery of the roller over which the looped end 45 of a cord 46 is received, the other end of the cord being connected to string 32 in the same manner as cord 35 of the previous embodiment. When the bow is to be flexed the loop 45 is attached to hook 44 and roller 43 is turned to a position such that the loop will not slip off the hook when the rack 26 is moved to the left to exert tension on the string 32 as shown in FIG. 4. The roller 43 is initially retained in this position by means of a spring 47 which has one end embedded in the roller 43. The free end 48 of the spring 47 bears against an adjustable stop, such as the bolt 49 threaded in the wall of the rack 26.

As a result, as the rack moves to the left, increasing tension in cord 46 exerts increasing force on the hook 44 to rotate roller 43 in a counterclockwise direction. This rotation is resisted by the spring 47, until a point is reached at which the free end 48 is bent to such an extent that it allows the roller 43 to turn counterclockwise a sufficient amount that the looped end 45 of the cord 46 slips off the end of hook 44 and tensioning string 32 is thereby released. By rotating the bolt 49 the force exerted by spring 47 can be varied so as to control the amount of tension to be exerted by cord 46 and string 32 on the limbs 21 before release occurs.

A modified form of force multiplying means is shown in FIGS. 5 and 6. In this modification the shaft 28, carrying the lever 29, is rotatably mounted on a plate, or bracket, 50 secured to the handle 20. Shaft 28 carries a disk 51 upon one side of which there are placed two diametrically opposed axially projecting peripherally located pin 52 and 53. In the normal, unstressed condition of the force multiplying means the disk 51 is angularly position to place the pins 52 and 53 adjacent to, and on respective opposite sides of, the tensioning string 32. On the bracket 50 there are also mounted a pair of small rollers 54 and 55 located adjacent to opposite sides of the periphery of the disk 51 and also adjacent to, and on respective opposite sides of, the string 32. In addition, roller 54 lies on the side of string 32 opposite to that of pin 52, and roller 55 lies on the side opposite to pin 52. Finally, bracket 50 also supports a pair of wedge-shaped members 56, mounted on the end of arms 57 attached to bracket 50 so as to place members 56 in position to overhang the exposed face of disk 51, at a location anguarly related to tensioning string 32 when at rest.

In operation, when the archer pulls back on the drawstring 22, the string 30 pulls lever 29 to rotate disk 51 in a clockwise direction with the result that the pins 52 and 53 being to displace a short section 32*a* of string 32 in a rotary direction with respect to fixed rollers 54 and 55. This causes a shortening in the overall length of tensioning string 32 to bend the limbs 21 in a backward direction. Tension in string 32 therefore increases until rotation of the disk 51 brings the string section 32*a* into contact with the upwardly sloping surfaces 58 of the wedge-shaped members 56. The upper ends of the sloping surfaces are disposed at a level above the tops of pins 52 and 53 so a point will be reached when these sloping surfaces will lift the string section 32*a* off of the pins and cause an immediate release of the limbs 21 as the string 32 returns to its initial straight condition as shown in FIG. 5. When the arrow has been dispatched by release of the backwardly pulled drawstring 22, the disc 51 can be returned to its initial position by lifting the string section 32*a* to allow the pins 52 and 53 to pass under it and return to their positions as shown in FIG. 5.

The force mechanism, indicated generally by numeral 59 in FIG. 7, is similar to that of FIG. 1, with the exception that the tension in string 32 is increased by pushing the center portion toward drawstring 22 rather than by pulling it toward handle 20. As in the previous form the gear 27 is attached to one end of a shaft 28 rotatably mounted on a plate, or bracket, 60 which extends rearwardly from the bow handle 20. Shaft 29 has an arm 29 attached at its other end and the free end of the shaft is connected to drawstring 22 by means of a cord 30 so that when the drawstring is pulled by the archer the gear 27 is rotated in a clockwise direction. A guideway 61 mounted on bracket 60 slideably supports a toothed rack 62 an engagement with the upper periphery of gear 27. Bracket 60 also supports a pair of grooved rollers 63, spaced from each other and just to the rear of the tensioning string 32 when in its normal condition. An elongated rigid member, such as a rod, indicated by numeral 64, is connected at one end to string 32 at a point between the rollers 63 and at its other end is provided with a tripping mechanism 65 which is similar to that used in the rack 26 shown in FIG. 3.

In operation, when the drawstring 22 is pulled by the archer, the cord 30 rotates arm 29 and gear 28 in clockwise direction to move the rack 62 towards the right, in FIG. 7. The rod 64 pushes that portion of tensioning string 32 between rollers 63 towards the right to shorten string 32 and bend the limbs 21 as the drawstring 22 continues to be pulled to the right. At a preselected point in the travel of rack 62 the tripping mechanism 65 will release the rod 64 and tensioning string 32 will return to its normal condition, allowing limbs 21 to draw the string 22 taut to propel the arrow forward.

The modification shown in FIG. 8 is electrically operated, such as by the use of a rechargeable battery 66 which can be carried within a compartment provided in handle 20. While a circuit diagram is shown in FIG. 9, no attempt has been made to show the arrangement of the wiring in FIG. 8.

As shown in FIG. 8, a mounting bracket 67 extends backwardly from the handle 20 of the bow to rotatably driving motor 68 which can be supplied with electrical energy supplied by a battery removably concealed within the compartment 66. The motor may include speed reduction gearing (not shown) connected with the driving element of an electrically operated clutch means 69, the driven element of which is connected to a pinion gear 70. The bracket 67 also rotatably supports a disk 71, a portion of the periphery of which includes a toothed sector 72 which engages with pinion gear 70. On the face of the disk a pair of diametrically spaced pins 73 and 74 are located close to, and on opposite sides of, a short length 75 of the tensioning string 32. The bracket 67 also supports a pair of small rollers 76 and 77 placed diametrically across from each other adjacent the periphery of the disk 71 and on respective opposite sides of string 32 from the pins 73 and 74. The arrangement of these pins and rollers is similar in purpose to the arrangement of pins 52 and 53 and rollers 54 and 55 shown in FIGS. 5 and 6. A cord, or string, 78 is attached at one end to the drawstring 22 while its other end is connected by an elastic member such as coil spring 79 to a normally open switch 80 mounted on the handle 20. A normally closed switch 81 is mounted on bracket 67 in a position to be opened upon contact with an actuator 82 mounted in an an arcuate slot 83 on disk on disk 71 which permits angular adjustment of the actuator.

In operation, when the archer pulls back on the drawstring 22, this movement causes the cord 78, acting through spring 79, to close switch 80. As can be seen from FIG. 9, this causes both motor 68 and clutch 69 to be actuated since switch 81 is normally closed. Operation of the motor and clutch, connected to pinion 70, initiates rotation of disk 71 in a clockwise direction and this means that the pins 73 and 74 to rotate the section 75 of the string in the same direction. This movement, in combination with the rollers 76 and 77 causes a shortening in the length of tensioning string 32 and multiplies the force, combined with that of the archer's pull on string 22, drawing the bow limbs 21 inwardly. It should be noted that, while the actuator of switch 80 only requires a short amount of movement to close the switch, the spring 79 allows substantially unlimited movement of string 22 and, that as long as the string 22 is displaced in a rearward direction the motor 68 and clutch 69 will continue to rotate disk 71 until a point is reached at which the actuator 82 comes into contact with the actuator of switch 81. At this point the normally closed switch 81 will open, cutting the circuit between the battery and clutch 69, although allowing motor 68 to continue to run. This immediately allows the gear 70 to run free and the tension in string 32 will force disk 71 back to its original position, allowing the limbs to apply their full force on drawstring 22 for propelling the arrow. In order to prevent further application of power from the motor 68 to disk 71, a simple mechanical latch (not shown) can be used to either keep the clutch 69 disengaged or switch 81 open until the arrow has been released.

I claim:

1. An archery bow for propelling an arrow comprising a handle section having a pair of oppositely outwardly projecting limbs, each limb having a free end, and a drawstring having two ends adapted for propelling an arrow, which ends are respectively connected to the free ends of said limbs, the combination including:

(a) a means for force multiplication mounted on the bow separate from said drawstring and connected between said resilient limbs for exerting flexing force on said limbs independently of the drawstring in response to drawing movement of the drawstring;

(b) triggering means for releasing said flexing force from said limbs when flexed, whereby the fully reactive force of said flexed limbs is transferred from the force multiplying means directly to the drawstring;

(c) a second string having two ends connected at each end at points of attachment to said limbs, said second string extending between said limbs, said second string having an effective length, each end of said second string respectively being connected to respective ones of said limbs at a location on said respective ones of said limbs between the location of attachment of said force multiplying means to said respective ones of said limbs and respective ones of said points of attachment of respective ones of said two ends of drawstring to said limbs; said means for force multiplication including a lever pivotally mounted to said handle section; said lever having a first moment arm and a second moment arm; said first moment arm being greater in length than said second moment arm; a means for connecting said drawstring to said first moment arm, such that drawing of said drawstring causes movement of said lever; a means for connecting said second moment arm to said second string, such that movement of said second moment arm causes a force to be exerted upon a portion of said second string; said effective string length being the linear distance between the points of attachment of said second string to said limbs; and (d) means for shortening the effective length of said second string between said points of attachment of said second string to said limbs, said means for shortening the effective length being connected to said second moment arm so as to be displaced thereby, said means for shortening being connected to said drawstring such that displacement of said drawstring in a predetermined direction causes displacement of said lever in a predetermined direction causing movement of said second moment arm in turn causing displacement of a predetermined portion of said second string so as to shorten the effective length of said second string which thereby creates inward tension of said limbs.

2. An archery bow as defined in claim 1, wherein said means for shortening the effective length of the second string includes; a support mounted on the handle of the bow; a slidable element slidably mounted on said support; and a linkage connecting the slidable element with the drawstring for movement in a predetermined direction when the drawstring is pulled; said triggering means comprising; a detent having two separable members, one member being attached to a medial point of said second string to pull said medial point in a transverse direction when the slidable element moves in said predetermined direction; and a releasable connector means for connecting said two separable members together to release said two separable members from each other when the force of said pulling exceeds a predetermined value.

3. An archery bow as defined in claim 2, wherein said slidable element comprises a toothed rack, and said lever includes a gear in meshing engagement with said rack.

* * * * *